United States Patent [19]

Camilleri

[11] 4,198,473

[45] Apr. 15, 1980

[54] RESPOT CELL PADS FOR AUTOMATIC BOWLING MACHINE

[76] Inventor: Thomas M. Camilleri, 277 Avenue W, Brooklyn, N.Y. 11223

[21] Appl. No.: 868,194

[22] Filed: Jan. 9, 1978

Related U.S. Application Data

[63] Continuation-in-part of Ser. No. 724,632, Sep. 20, 1976, abandoned, which is a continuation-in-part of Ser. No. 554,908, Mar. 3, 1975, abandoned.

[51] Int. Cl.[2] ..... B32B 3/26; B32B 5/18

[52] U.S. Cl. ..... 428/542; 273/42 A; 273/43 A; 428/310; 428/311; 428/315

[58] Field of Search ..... 428/64, 71, 158-160, 428/220, 306, 310, 311, 314, 315, 327, 338, 339, 542; 273/42 A, 43 A; 260/2.5 AZ; 264/DIG. 14

[56] References Cited

U.S. PATENT DOCUMENTS

| | | | |
|---|---|---|---|
| 2,817,528 | 12/1957 | Sanford | 294/119 |
| 3,050,306 | 8/1962 | Blough | 273/42 A |
| 3,094,325 | 6/1963 | Torresen et al. | 273/42 A |
| 3,574,150 | 4/1971 | Jefferson et al. | 428/338 X |
| 3,594,335 | 7/1971 | Schultz et al. | 428/306 X |
| 3,595,734 | 7/1971 | Krug | 428/315 X |
| 3,717,559 | 2/1973 | Oyama et al. | 260/2.5 HA X |
| 3,770,663 | 11/1973 | Ueki et al. | 260/2.5 HA X |

OTHER PUBLICATIONS

Webster's New World Dictionary; the definition of "foam"; Second College Edition, p. 540.

*Primary Examiner*—Marion E. McCamish
*Assistant Examiner*—Alexander S. Thomas
*Attorney, Agent, or Firm*—D. J. Perrella

[57] ABSTRACT

An improved respot cell pad for a pinspotter automatic bowling machine is formed of high density flexible, resilient, compression resistent cellular material.

9 Claims, 1 Drawing Figure

RESPOT CELL PADS FOR AUTOMATIC BOWLING MACHINE

RELATED APPLICATION

This application is a continuation-in-part of copending application Ser. No. 724,632 filed Sept. 20, 1976, now abandoned, which in turn is a continuation-in-part of application Ser. No. 554,908, filed Mar. 3, 1975, now abandoned.

BACKGROUND OF THE INVENTION

1. Field of the Invention

This invention relates to pinspotter automatic bowling machines. More particularly, it relates to respot cell pads for pinspotter automatic bowling machines.

Automatic pinspotter machines are manufactured by AMF Corp. The mechanism for raising the pins remaining standing after a ball is thrown by the bowler comprises a respot cell containing a block-shaped actuating member (actuator pad) which engages the top of the pin and two smaller block-shaped gripping members (gripper pads) which engage opposite sides of the pin for raising and lowering the pin. These members are made of foam rubber and rapidly lose their elasticity and resilience, in use, become hard, and suffer severe erosion necessitating frequent and expensive replacement. The actuator pad has a length of approximately 5.5 inches (13.97 cm), a width of approximately 3.75 inches (9.53 cm) and a height of approximately 0.75 inch (1.91 cm). It is made of foam rubber and has a density of about 22 lbs. per cubic foot (0.36 g/cc). The head of the pin must depress the foam about 0.5 inch (0.127 cm) in order to actuate the respot cell and cause the gripper pads to engage the pin. In use, the actuator pad loses its resilience and elasticity and becomes eroded by contact with the head of the pin. The result is a hole in the pad where the pad contacts the head of the pin. When this happens, a short pin, i.e., one that has been refinished by cutting off from about 0.125 inch (0.32 cm) to about 0.25 inch (0.64 cm) from the bottom to remove a cracked or chipped bottom, will fail to actuate the respot cell and even an unfinished pin of normal heigth will fail to actuate the respot cell when an excessive amount of actuating pad has been worn away. In this situation a standing pin will not be lifted and will be swept to the rear of the machine and incorrectly be recorded as a pin which has been knocked down.

In order to overcome some of the foregoing difficulties, this type of respot cell is sometimes fitted with a hard rubber actuator pad having the same length and width as the foregoing pad but a thickness slightly over about 0.25 inch (0.64 cm) and a density of about 1.37 g/cc. In this situation, because the actuating pad is much thinner, the height of the table on which all of the respot cells are mounted becomes much more critical and must be calibrated accurately to the height of the top of the pin. If the table is set too high, such a respot cell will not descend far enough to contact the pin, and so will fail to pick up the pin. A similar result will occur in the case of a shortened pin. On the other hand, if the table is set too low, the actuator pad will strike the head of the pin with considerable force and result in damage to the head of the pin and/or cause the machine to blackout, that is to say, to stop, requiring manual intervention to restart.

As indicated above, associated with the actuator pad are two gripper pads which cooperate with the actuating pad and engage opposite sides of the neck of the pin to raise and lower the pin. The gripper pad is also formed of foam rubber having a density similar to that of the actuator pad and is about 4.5 inches (11.43 cm) long, about 1 inch (2.54 cm) wide and about 1.5 inches (3.81 cm) in height. The 1.5 inch side is the side which engages the neck of the pin. The gripper pads suffer the same disadvantages as the actuating pads and wear out even more rapidly. After several months the gripper pad loses its resilience and elasticity. It then fails to grip the pins firmly whereby the pins are liable to slip and fall when being raised and lowered. With continued use, the surface becomes eroded and the foregoing difficulties are magnified.

In addition both the foregoing actuator pads and gripper pads are damaged by oil from the pinsetting machine and by the oils used to condition the lanes of the bowling alley.

OBJECTS OF THE INVENTION

It is, accordingly, an object of the present invention to provide improved actuator and gripper pads for respot cells. Another object is to provide acutator and gripper pads which retain their resilience and elasticity. A further object is to provide actuator and gripper pads which do not harden is use and which resist erosion. Still another object is to provide long lasting actuator and gripper pads. These and other objects of the present invention will be apparent from the following description.

SUMMARY OF THE INVENTION

Improved respot cell actuator and gripper pads for pinspotter automatic bowling machines are formed of high density flexible, resilient, compression resistant cellular material.

DETAILED DESCRIPTION

Figure 1:
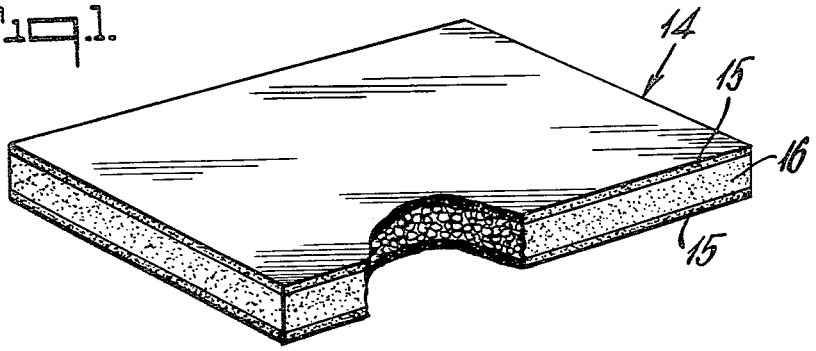
FIG. 1 is a perspective view of an actuator pad partly broken away to show the interior cellular structure.

It has now been found that respot cells perform with high degree of efficiency when actuator pads and gripper pads are formed of a high density open cell rubber having a density of from about 26 to about 40 lbs. per cubic foot (about 0.40 to about 0.65 g/cc), preferably a density of from about 30 to about 34 lbs. per cubic foot (about 0.48 to about 0.55 g/cc.), and most preferably a density of about 32 lbs. per cubic foot (0.51 g/cc.). Pads made of this type of sponge rubber are much more resistant to compression than are conventional pads. A very suitable pad is made from chemically blown open-cell sponge made of natural or synthetic rubber, e.g. neoprene, in the foregoing density ranges. A specific example of such a material is Kem-blo, a chemically blown open-cell sponge made by Uniroyal's Expanded Products Department.

FIG. 1 shows an actuator pad 14 formed of open cell sponge 16 and having a skin 15 on upper and lower surfaces. The gripper pad is similar, differing only in its dimensions. The actuator and gripper pads of the present invention have a density significantly higher than than conventional pads made of foam rubber and are considerably more resistant to deformation. Because of this, initial contact of the head of the pin with the actuating pad, i.e. when the pin depresses the pad only about 0.25 inch (0.65 cm) causes the gripper pads to engage the sides of the pin. With conventional foam rubber actuator pads, the pin must depress the foam about 0.5 inch (1.28 cm) before the gripper pads are actuated. Thus, a short pin will actuate a respot cell equipped with an actuator pad according to the present invention whereas it would not actuate one equipped with a conventional foam rubber pad. Moreover, the gripper pads of the present invention will hold the pin without danger of dropping, even if the pin is oil coated or has lost its head flange due to refinishing.

The actuator pads and gripper pads of the present invention maintain their resilience and gripping power during extended use and are substantially impervious to damage by machine oils and the oils used to condition the lanes of the bowling alley.

What is claimed is:

1. In a block-shaped resilient actuator pad or gripper pad for a pinsetter automatic bowling machine, the improvement wherein the actuator pad or gripper pad is formed of a flexible, resilient sponge rubber having a density of from about 26 to about 40 pounds per cubic foot.

2. The actuator pad or gripper pad of claim 1 having a density of from about 30 to about 34 pounds per cubic foot.

3. The actuator or gripper pad of claim 2 wherein the rubber is natural rubber and the cellular structure is produced by a chemical blowing agent.

4. The actuator or gripper pad of claim 2 wherein the rubber is synthetic rubber and the cellular structure is produced by a chemical blowing agent.

5. The actuator pad or gripper pad of claim 1 having a density of about 32 pounds per cubic foot.

6. The actuator or gripper pad of claim 1 wherein the rubber is natural rubber.

7. The actuator or gripper pad of claim 6 wherein the cellular structure is produced by means of a chemical blowing agent.

8. The actuator or gripper pad of claim 1 wherein the rubber is synthetic rubber.

9. The actuator or gripper pad of claim 8 wherein the cellular structure is produced by means of a chemical blowing agent.

* * * * *